United States Patent [19]

Gibson et al.

[11] Patent Number: 4,977,346

[45] Date of Patent: Dec. 11, 1990

[54] HIGH PRESSURE SODIUM DISCHARGE LAMP HAVING GAS FILLED OUTER ENVELOPE

[75] Inventors: Ray G. Gibson, Bath, N.Y.; Joseph Droho, Chicago, Ill.

[73] Assignee: North American Philips Corp., New York, N.Y.

[21] Appl. No.: 414,640

[22] Filed: Sep. 28, 1989

Related U.S. Application Data

[63] Continuation of Ser. No. 212,803, Jun. 29, 1988, abandoned.

[51] Int. Cl.[5] ..... H01J 61/34; H01J 61/56

[52] U.S. Cl. ..... 313/25; 313/576; 313/603; 313/643

[58] Field of Search ..... 313/25, 113, 601, 603, 313/619, 642, 643, 573, 574, 576

[56] References Cited

U.S. PATENT DOCUMENTS

| | | | |
|---|---|---|---|
| 3,280,371 | 10/1966 | Toda et al. | 315/290 |
| 4,431,945 | 2/1984 | Kawashima et al. | 313/619 X |
| 4,758,759 | 7/1988 | Scholz et al. | 313/25 |

FOREIGN PATENT DOCUMENTS

| | | |
|---|---|---|
| 1585041 | 2/1981 | United Kingdom . |
| 2097179 | 10/1982 | United Kingdom . |

*Primary Examiner*—Kenneth Wieder
*Attorney, Agent, or Firm*—Emmanuel J. Lobato

[57] ABSTRACT

A discharge lamp comprises an HPS discharge device within an outer envelope filled with inert gas. A normally nonconductive spark gap device within the outer envelope is connected across conductors used to apply a voltage to the HPS discharge device. The spark gap breaks down when the applied voltage exceeds a certain value to prevent breakdown through the inert gas within the outer envelope.

8 Claims, 7 Drawing Sheets

HIGH PRESSURE SODIUM DISCHARGE LAMP HAVING GAS FILLED OUTER ENVELOPE

This is a continuation of application Ser. No. 212,803, filed June 29, 1988, now abandoned.

CROSS REFERENCE TO RELATED APPLICATIONS

The copending application Ser. No. 212,811 filed concurrently with this application entitled High Pressure Sodium Discharge Reflector Lamp of Ray G. Gibson, III discloses and claims a reflector lamp having a gas filled outer envelope for preventing implosion in the event the outer envelope breaks.

The copending application Ser. No. 212,818 filed concurrently with this application entitled High Pressure Sodium Discharge Tube Support Structure of Ray G. Gibson, III and Jagannathan Ravi discloses and claims an HPS lamp having a gas filled outer envelope with discharge tube support structure designed to operate in a rare gas atmosphere and to avoid electrical breakdown through the gas atmosphere.

BACKGROUND OF THE INVENTION

The present invention relates to high pressure sodium vapor high intensity discharge lamps, and more particularly to such lamps having a gas filled outer envelope.

High pressure sodium discharge lamps are comprised of a discharge device mounted in an evacuated outer envelope. The discharge device is typically a ceramic discharge vessel comprised of alumina or sapphire and having conductive terminals for receiving an operating voltage. The conductive terminals are niobium which is used because its coefficient of thermal expansion matches that of alumina and because it is resistant to sodium vapor. Titanium solder is used in connections to the niobium.

The outer envelope is evacuated in order to thermally isolate the discharge device, and to avoid reactions of any gas within the outer envelope with the discharge device. Nitrogen, which is used in the outer envelope of other types of high intensity discharge lamps, cannot be used in high pressure sodium lamps because of its reactivity with niobium and titanium at high temperature.

The evacuated outer envelope of high pressure sodium lamps must be strong and able to withstand severe mechanical impacts without breaking. If the lamp outer envelope were to break, it would implode scattering glass fragments and create a safety hazard.

It has been the practice to manufacture high pressure sodium lamps with evacuated outer envelopes, and to make those envelopes sufficiently strong to avoid breakage. However, high envelope strength is not feasible in the case of many reflector lamps. Reflector lamp envelopes have a large face that merges with the envelope side walls at an edge portion having a small radius of curvature. The atmospheric pressure acting on the evacuated envelope causes high stress concentrations in the edge portion and makes it susceptible to breakage. Moreover, reflector lamps have thin blown glass envelopes and cannot be strengthened by making them substantially thicker. Incandescent reflector lamps having blown glass envelopes uniformly contain a fill gas with an internal pressure of about one atmosphere. With the inner and outer pressures acting on the envelope being approximately equal, no implosion will occur if the envelope breaks and there is less apt to be flying glass fragments.

There has been some consideration of gas filled high pressure sodium lamps. U.S. Pat. No. 3,932,781 issued to Jozef C. I. Peeters et al. discloses a high pressure sodium lamp having an outer envelope that is gas filled to inhibit evaporation of the alumina discharge tube. This reduces the deposition of alumina on the outer envelope and the attendant reduction in light output. The results of experiments involving such a lamp are also disclosed in the article by R. J. Campbell et al., "Evaporation studies of the sintered aluminum oxide discharge tubes used in high pressure sodium (HPS) lamps", Journal of the IES, July 1980, pages 233–239.

The introduction of a fill gas into the outer envelope of a high pressure sodium discharge lamp presents the problem of voltage breakdown through the gas. These lamps have closely spaced metal parts having a potential difference of around 4000 volts during lamp operation. In the high vacuum of conventional high pressure sodium lamps electrical breakdown between the lamp parts was not a problem. A fill gas has the potential of ionizing and providing a conductive path between the internal lamp parts at the different potentials and electrical breakdown can occur.

Accordingly, it is an object of the invention to provide a high pressure sodium discharge lamp having a gas filled outer envelope in which electrical breakdown through the fill gas is prevented.

SUMMARY OF THE INVENTION

According to the invention a high pressure sodium discharge lamp has an outer envelope, a high pressure sodium discharge device within said outer envelope, and an inert gas within the outer envelope. The lamp further comprises means within the outer envelope connected across conductors supplying a voltage to the discharge device for exhibiting a high impedance below a certain applied voltage and a low impedance above the certain applied voltage. The voltage at which the impedance changes is selected to be lower than the breakdown voltage through the inert gas atmosphere within the outer envelope.

In a preferred embodiment the means for changing impedance is comprised of a spark gap device. The spark gap is enclosed within the body of the device and isolated from the inert gas atmosphere within the outer envelope.

DETAILED DESCRIPTION OF THE INVENTION

Figure 1:
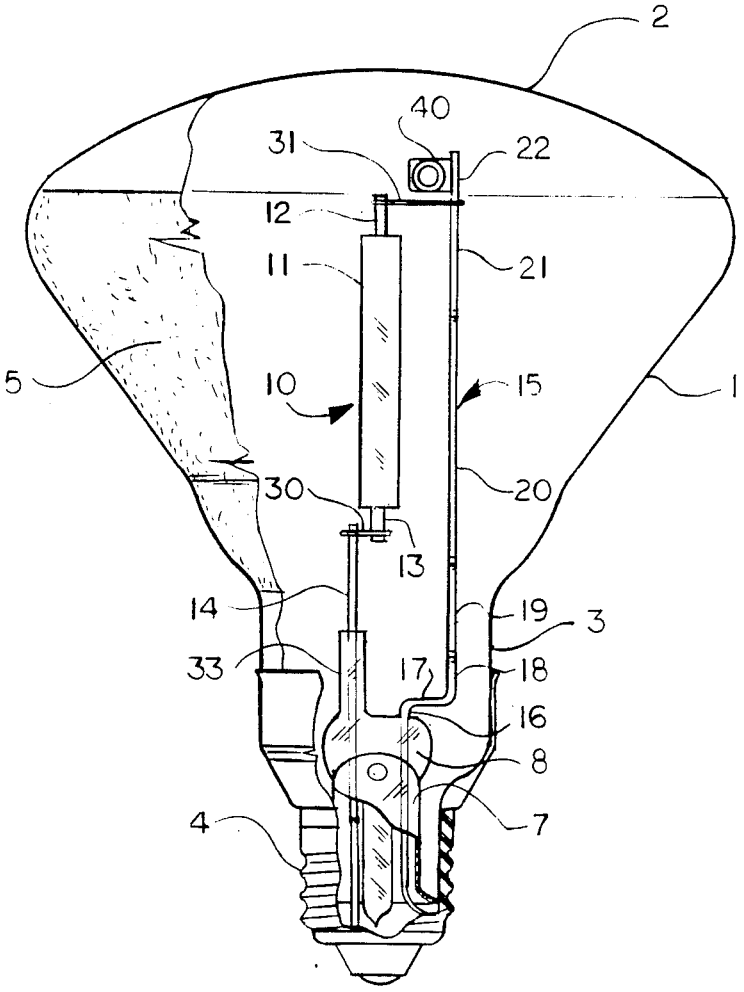
FIG. 1 is a partial vertical section of an HPS reflector lamp with blown glass envelope according to the invention.

FIG. 1 illustrates a high pressure sodium reflector lamp having a blown glass envelope. The envelope has a transparent or translucent front dome 1 from which light is emitted during lamp operation. A mid-section 2 converges toward a narrow neck 3 which terminates at the base end of the lamp envelope. A lamp base 4 is mounted on the base end of the envelope opposite the front dome 1.

A reflective layer 5 is disposed over at least a portion of the converging mid-section 2 of the lamp envelope. It is illustrated extending up to the edge of the dome 1 of the lamp envelope, and down onto a part of the narrow neck 3. The reflective layer 5 is typically metallic aluminum which is vapor deposited on the inner surface of the envelope. A high pressure sodium discharge device 10 is mounted axially symmetrically within the envelope and emits light which is incident on the reflective layer 5. The convergence of the envelope mid-section 2 having the reflective layer 5 is effective to reflect light from the light source 10 in a forward direction through the dome end of the envelope so as to concentrate the light and give it directivity.

The high pressure sodium discharge device 10 has a translucent body 11 and a pair of terminals 12, 13 each extending from a respective end of the tubular body 11. When a sufficiently high voltage is applied across the terminals 12 and 13, an electrical discharge is established between a pair of spaced internal electrodes (not shown) within the tubular body 11 and intense visible light is emitted.

The discharge device 10 is mounted within the envelope by a frame structure which also comprises conductors for applying an operating voltage to the discharge device. The base end of the envelope is closed by a stem 7 which is terminated at a pinch seal 8. A pair of rigid support conductors 14, 15 emerge from the pinch seal 8 and extend longitudinally of the envelope toward the dome end 1. The shorter conductor 14 has a free end which is connected to the terminal 13 of the discharge device by a conductive link 21. Similarly, the free end of the longer conductor 15 is attached to the terminal 12 by the conductive link 22. Each of the support conductors 14, 15 extend into the pinch seal 8 and are connected by respective conductive leads to the lamp base 4, in a conventional manner. Consequently, a voltage applied across the lamp base 4 is developed across the terminals 12, 13 of the high pressure sodium discharge device 10 for energizing it to emit light.

In order to avoid the danger of implosion upon breakage of the outer envelope 1, the outer envelope contains rare gas at a fill pressure of about 700 torr at room temperature. At the lamp operating temperature, the rare gas pressure is greater than one atmosphere (760 torr), in one example 930 torr, so there is no substantial pressure difference across the wall of the lamp envelope. Consequently, if the envelope is broken there will be no substantial pressure difference to accelerate glass fragments and cause flying fragments of the broken envelope. The rare fill gas within the outer envelope thus makes it safe to use thin blown glass outer envelopes in high pressure sodium reflector lamps.

The use of a rare fill gas in the outer envelope of a high pressure sodium lamp has certain consequences for the lamp's characteristics. These in turn dictate that the lamp incorporate certain structural features.

A major and substantial consequence of the use of the rare fill gas is the lowering of the breakdown voltage between internal lamp components. The American National Standards Institute (ANSI) recommends that the lamp be able to withstand an a.c. voltage of 4,000 volts peak. Commercially available high pressure sodium lamp starters produce a voltage pulse of up to 4000 volts having a duration of one millisecond. Conventional high pressure sodium lamps have a high internal vacuum of less than $10^{-4}$ torr in their outer envelope. As a result, internal metal components, such as discharge device mounting frame parts, can be as close as about three millimeters without a breakdown occurring at 4000 volts applied to the lamp.

The higher pressure rare gas fill increases the probability of internal voltage breakdown being caused by the 4,000 volt starting pulse. In order to avoid breakdown from occurring, the metallic components of the discharge device mounting structure are shaped to maximize the distance between the support conductors 14 and 15 that have an electrical potential between them during lamp operation.

Figure 2:
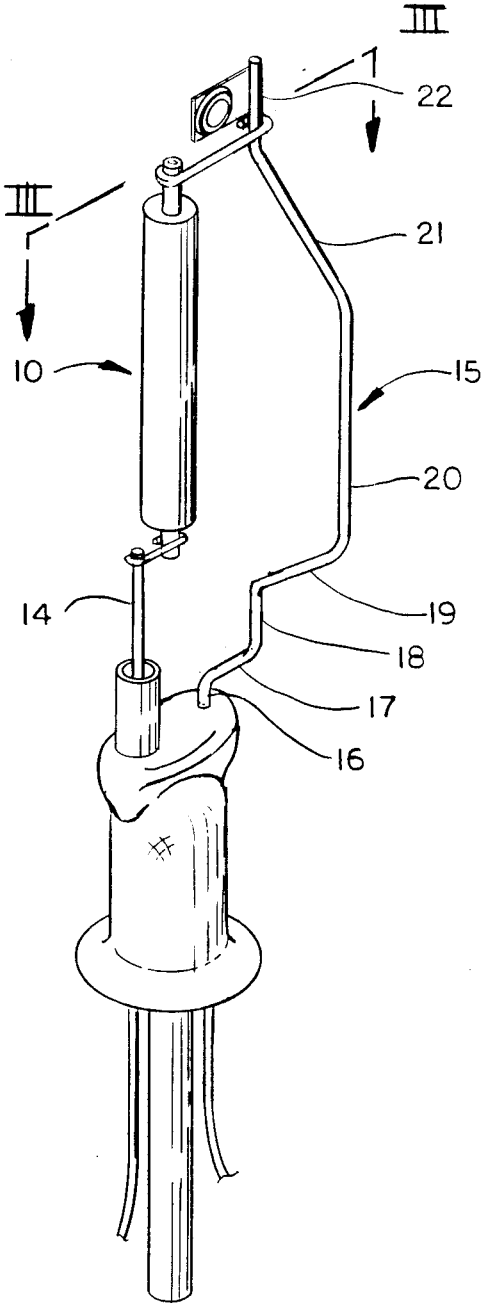
FIG. 2 is an isometric view of the discharge tube support structure shown in FIG. 1.

As shown in FIG. 2, the discharge device 10 is positioned on the lamp center line, and the short straight conductor 14 is on one side of the center line. The conductor 15 emerges from the pinch seal 8 on the opposite side of the lamp center line, and after a short length 16 it is bent perpendicular to the conductor 14. The section 17 of the conductor 15 extends perpendicularly away from the conductor 14, and is bent to define a portion 18 extending parallel to the conductor 14. The next portion 19 extends away from the imaginary plane defined by the conductor 14 and the portions 16 and 17 of the conductor 15. The next section 20 again extends parallel to the lamp longitudinal direction, and the successive section 21 extends back toward the original line of direction of the section 18. The last section 22 of the conductor 15 extends along the same line of direction as the section 18. This structure allows sufficient separation between the conductors 14 and 15 and at the same time avoids the conductor 15 from coming too close to the reflective layer 5, which is typically a metallic and conductive layer such as aluminum.

Section 16 of the conductor 15 is the part that is closest to the conductor 14. This is where electrical breakdown is most likely to occur. In order to reduce the likelihood of breakdown, a glass sleeve 33 covers the portion of the conductor 14 opposite the section 16 of the conductor 15. The glass sleeve 33 increases the breakdown voltage between the conductors 14 and 15. The gas krypton was used in a reflector lamp having the glass sleeve 33 and did not break down. Thus, krypton fill gas provides a practicable way of eliminating the implosion problem.

In order to establish the effectiveness of the glass sleeve 33, high pressure sodium reflector lamps were made which were identical except that some had the sleeve and some did not. The lamps had 70 watt HPS discharge devices mounted in an RL-38 outer envelope filled with krypton at a pressure of 700 torr. The space between the conductor 14 and the section 16 of the conductor 15 was eight millimeters. After the lamp reached normal operating temperature, and power was interrupted, the application of a 4,000 volt one microsecond pulse caused arcing between the conductors 14 and 15, in the lamp without a glass sleeve. For the lamp with the glass sleeve 33, no arcing occurred as long as the terminal 13 of the HPS discharge device 10 was at least 13 millimeters from the conductor 15.

Figure 3:
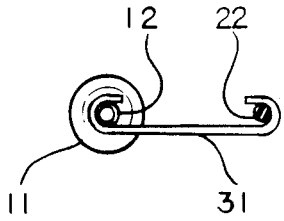
FIG. 3 is a partial cross section of the support structure shown in FIG. 2.

To further improve the breakdown characteristics of the lamp internal structure, all metallic parts are configured to eliminate sharp points and edges. Sharp points create regions of electric field concentration and may facilitate localized ionization of the rare fill gas which could initiate a breakdown between the conductors 14 and 15. In HPS lamps the discharge device is frequently attached to the supporting conductors by thin metallic ribbons or straight rigid rods. In the present invention, connectors 30 and 31 are made from wire having a circular cross section and are wrapped around the respective discharge device terminal and support conductor in the manner shown in FIG. 3. This eliminates the sharp edges or ends inherent in the prior art structure and avoids any attendant reduction in breakdown voltage. In a lamp having argon at 700 torr in the outer envelope, the curved connectors 30, 31 increased the breakdown voltage by 1000 peak a.c. volts relative to straight rod connectors.

A getter support 40 is attached to the section 22 at the free end of the conductor 15. This position maximizes the distance of the getter support 40 from the conductor 14 and also avoids reducing the internal breakdown voltage of the mounting frame structure.

The rare fill gas also contributes to dissipation of heat developed in the discharge device 10 during lamp operation. HPS discharge devices have minimum operating temperatures. If they are not sufficiently heated during operation their internal sodium vapor pressure will be too low and the light output will be substantially reduced. In order to compensate for thermal losses through the rare fill gas, the discharge device 10 is physically smaller than a discharge device for the same wattage used in an evacuated HPS lamp. The lamps described herein have a discharge device length of 41.8 millimeters as compared to the standard 48.0 millimeter length, and a 4.0 millimeter inside diameter as compared to the 4.8 millimeter standard. The smaller physical size reduces the area of the discharge device through which heat can transfer to the rare fill gas so that the discharge device operates at the correct temperature even though substantial amounts of thermal energy can be transferred through the rare gas.

The smaller HPS discharge device 10 results in a lamp for which the beam spread is substantially determined by the position of the discharge device along the center line of the lamp. This is shown by the data in the following Table I. The beam spread of the lamp can be set between 15 and 96 degrees by selecting the position of the discharge device within an interval of 15 millimeters. This broad range in beam spread was achieved with an RL-38 outer envelope.

TABLE I

| Mount Height (mm) | Beam Spread (deg.) | ANSI Notation |
|---|---|---|
| 72 | 15 | NSP |
| 74 | 23 | SP |
| 82 | 53 | WFL |
| 87 | 96 | VWFL |

The RL-38 bulb has a seal length (the distance from the base of the stem 7 to the dome 1) of 130 mm. The mount height is measured from the base of the stem 7 to the center of the discharge device 11. The lamps for which data is reported in Table I had a discharge device 41.8 mm in length, with an arc length of about 21 mm.

In the case of very wide flood lamps the HPS discharge device 10 is relatively closer to the dome end of the lamp envelope 1. This results in the lamp voltage being strongly dependent upon the orientation of the lamp during operation. When the lamp is operated in a base-up orientation the cooler end of the discharge device 10 will be at the dome end of the discharge envelope. Consequently, the sodium amalgam within the discharge device will condense at that end. On the other hand, when the lamp is operated in a base-down orientation the colder end of the discharge device will be at the base end of the discharge device 10 and that is where the sodium amalgam will condense.

In the base-up orientation, the lamp voltage will too high because of excessive reflected heat back onto the end of the discharge device which elevates the discharge device temperature. It was found that for the 70 watt lamp, the lamp voltage was 49.6 volts in the base-down orientation and 62.6 volts in the base-up orientation. The discharge device may be made unsymmetrical in order to eliminate the lamp voltage sensitivity to lamp operating position.

Figure 4:
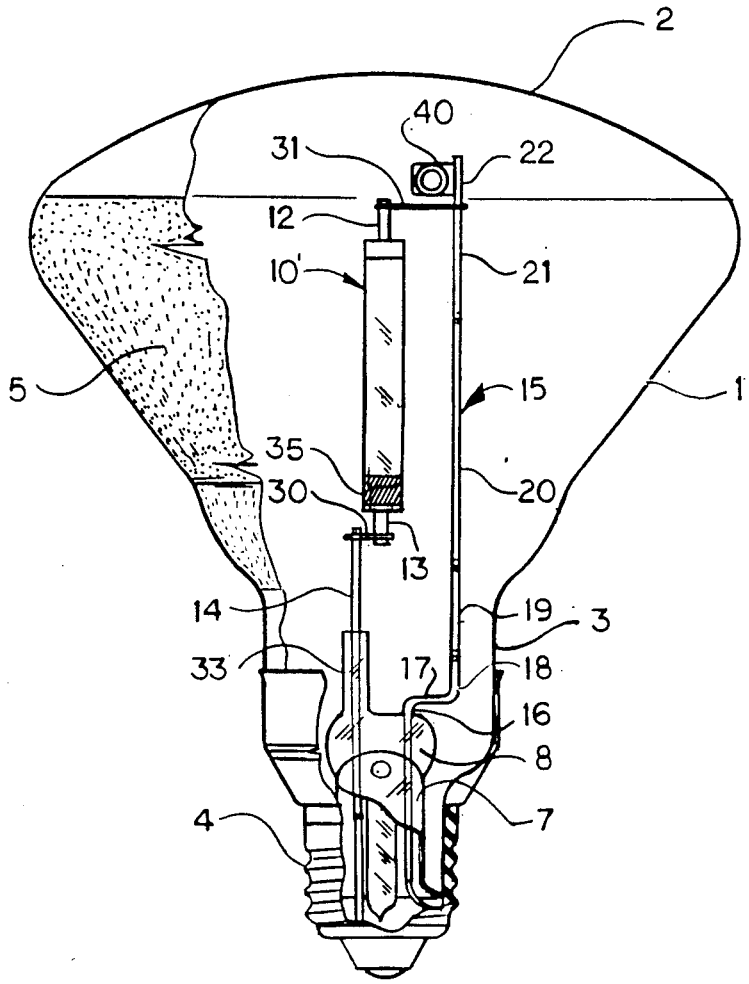
FIG. 4 is a partial vertical section of an HPS reflector lamp with a blown glass envelope in which the discharge tube has thermal control structure.

FIG. 4 illustrates an HPS reflector lamp having a discharge device 10' with a heat reflector 35 at its end closest to the lamp base. The heat reflector is effective for reflecting internally generated heat back into the discharge device 10' and maintaining the end of the discharge device 10' with the heat reflector 35 at a higher temperature.

Figure 5:
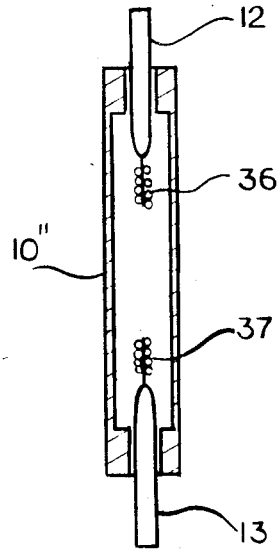
FIG. 5 is a vertical section of a high pressure sodium discharge tube having unsymmetrical structure for thermal control.

An alternative to the use of a heat reflector is the asymmetrical discharge device 10'' shown in FIG. 5. A pair of discharge electrodes 36, 37 are mounted internally at the ends of connectors 12 and 13, respectively. The distance from an electrode tip to an end wall of the discharge device 10 affects the end temperature of the discharge device; the shorter the distance the higher the temperature. A discharge device 10'' with an electrode tip to end wall distance for the electrode 36 of 7.75 millimeters and the tip to wall dimension for the electrode 37 of 7.25 millimeters was used in a reflector lamp with an RL-38 outer envelope. As shown in Table II, the 0.5 millimeter shorter distance reduced the variation in operating voltage to less than one volt.

TABLE II

| Electrode configuration | lamp voltage base down | lamp voltage base up | Δv |
|---|---|---|---|
| asymmetrical | 48.4 | 49.2 | 0.8 |
| symmetrical | 49.6 | 62.6 | 13.0 |

An asymmetrical discharge device can also be realized with equal electrode tip to end wall distances for both electrodes but with end walls of different thicknesses. The thicker end wall will dissipate more heat than the thinner end wall and thus operate at a lower temperature than the thinner end wall. By making the discharge device end wall that is closer to the envelope dome thicker than the more distant end wall, the heat reflected back from the envelope dome will be dissipated and the sensitivity of lamp operating voltage to position will be diminished.

Another approach to preventing electrical breakdown between the internal support conductors is to provide a circuit path within the lamp that will become conductive before unintentional breakdown occurs. The lamp shown in FIG. 6 includes an HPS discharge device 50 mounted within a lamp envelope by support conductors 51, 52 in the manner previously described. A voltage across the conductors 51, 52 is the voltage which is applied to the discharge device 50 for operating it. The lamp outer envelope contains the rare gas argon at a pressure of the order of 700 torr.

A switching device 60 is incorporated in the lamp to define a circuit path having a selected breakdown voltage which is lower than the breakdown voltage between the conductors 51 and 52. The circuit path is isolated from the argon atmosphere in the lamp envelope and has a normally high impedance. When the voltage between the support conductors 51 and 52 exceeds a certain threshold voltage a low impedance circuit path is established between the conductors 51, 52 through the switching device 60.

The switching device 60 is a spark gap device comprised of a non-conductive cylindrical wall 61 and conductive end closures 62, 63 and having an internal chamber. Internal electrodes 64, 65 are each mounted on a respective one of the conductive end closures 62, 63. Lead 66 extends from the conductive end closure 62, and lead 67 extends from the conductive end closure 63. The leads 66 and 67 are each connected to a respective one of the conductors 52, 51 so that the potential applied across the discharge device 50 is also applied across the spark gap device 60. The chamber of the spark gap device 60 has a gas fill selected to establish a particular breakdown voltage.

The voltage difference between the conductors 51 and 52 is applied through the leads 66 and 67 to the respective conductive end closures 62 and 63. Consequently, the voltage difference between the conductors 51 and 52 exists between the internal electrodes 64, 65. When that voltage difference exceeds the selected breakdown voltage of the spark gap device 60, the gas fill within the spark gap device 60 ionizes and a discharge or spark occurs between the internal electrodes 64 and 65. The spark gap device 60 has a low impedance and is conductive, and the voltage difference between the conductors 51 and 52 is short circuited before breakdown of the argon fill gas within the lamp outer envelope can occur.

When the voltage between the conductors 51 and 52 decreases below the switching device threshold voltage, the discharge through the gas fill within the device 60 stops and its impedance increases to the normal high impedance value. The switching device 60 is a self-restoring device and can be repeatedly switched to its low impedance conductive state and each time it will return to its high impedance condition after the applied voltage decreases below its threshold voltage.

Figure 6:
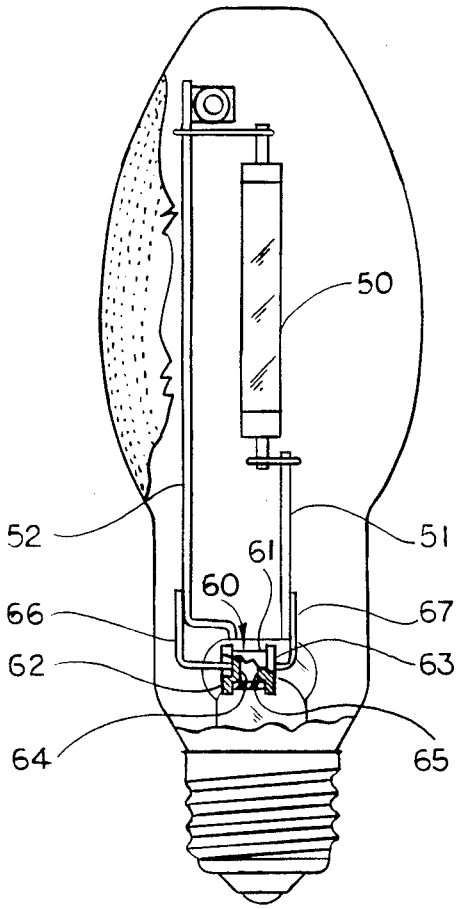
FIG. 6 is a partial vertical section of an HPS reflector lamp according to the invention having structure for preventing internal electrical breakdown.
Figure 7:
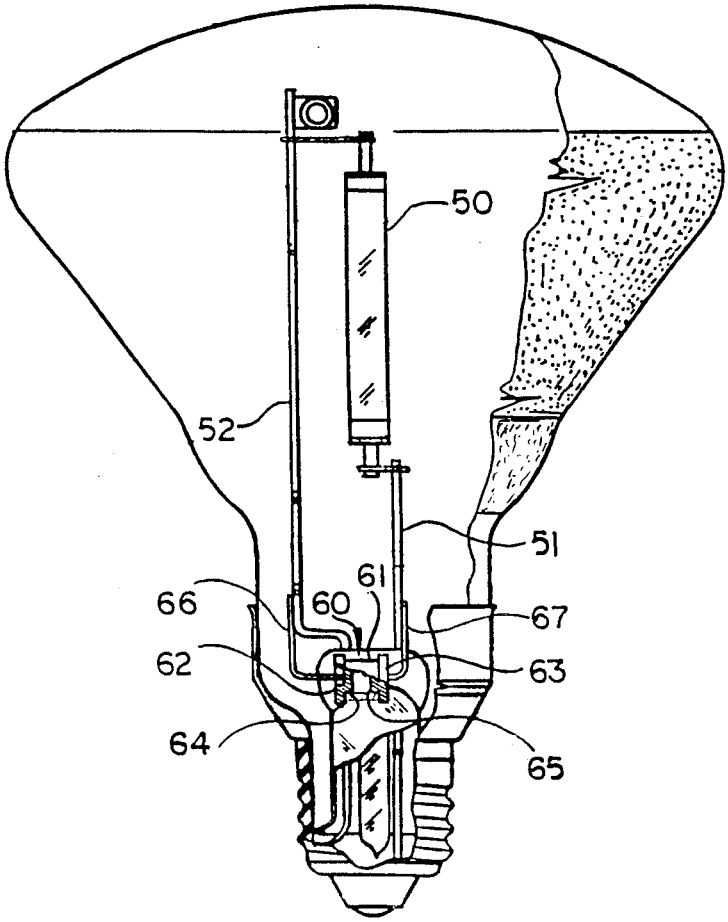
FIG. 7 is a partial vertical section of an HPS reflector lamp like that shown in FIG. 1 and having structure for preventing internal electrode breakdown.

FIG. 7 illustrates a reflector lamp having a discharge switching device like that incorporated in the lamp of FIG. 6. The controlled and isolated discharge path provided by the switching device is particularly advantageous in a reflector lamp. The reflector lamp includes a reflective layer such as metallic aluminum which is conductive. The metallic reflective layer can provide part of a breakdown path between the conductors 51 and 52. For example, an electrical breakdown could occur through the argon fill gas between the conductor 51 and the reflective layer, and between the reflective layer and the conductor 52. The metallic conductive layer would thus provide part of the breakdown path between the conductors.

Figure 8:
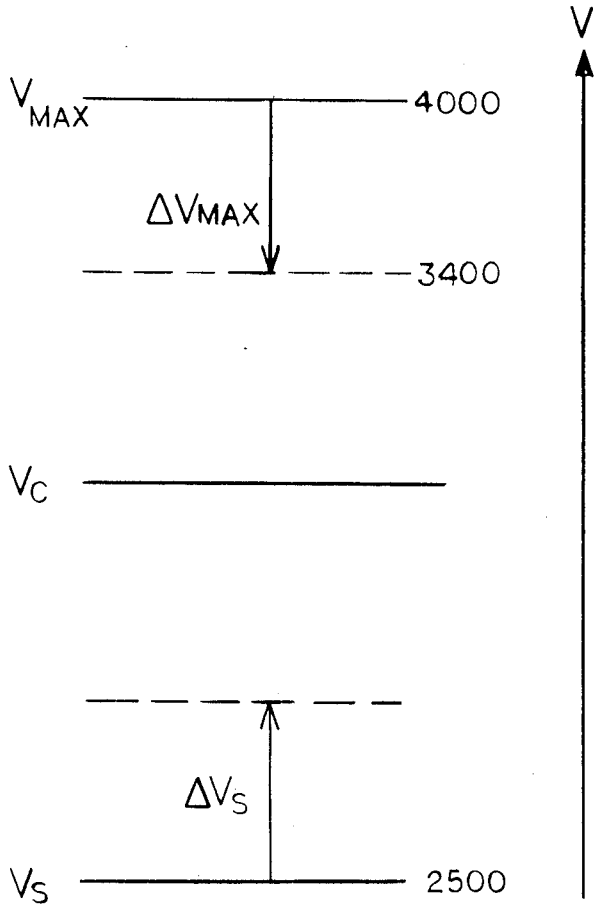
FIG. 8 is a graph illustrating the relative magnitudes of different voltages that characterize the lamp operation.

FIG. 8 illustrates the relationship among the various voltage magnitudes which define the modes of operation of the invention. The starting voltage $V_s$ of the discharge device 10 is typically around 2500 volts for a high pressure sodium lamp; the 70 watt discharge device used in the lamps made and discussed herein have a starting voltage of less than 1800 volts. The maximum voltage $V_{max}$ that the lamp should withstand is nominally 4,000 volts. The controlled breakdown voltage $V_c$ of the spark gap device is selected to have a value between $V_s$ and $V_{max}$.

Both $V_s$ and $V_{max}$ change as the temperature of the lamp increases during lamp operation. As the lamp heats, the breakdown voltage of the argon gas within the lamp outer envelope decreases. This was an unexpected result because the breakdown voltage should have been independent of pressure at the constant gas density expected in a sealed lamp. The decrease in breakdown voltage was measured in a lamp having an outer envelope filled with argon at 700 torr and a stem like that shown in FIG. 2 but without the glass sleeve 33. At the lamp operating temperature, the internal breakdown voltage will decrease by about 500 volts to 3500 volts. At the same time, the internal pressure of the sodium vapor within the discharge device 10 increases substantially and the starting voltage increases. In fact, the starting voltage may increase to a value greater than the controlled breakdown voltage $V_c$ of the arc gap device. The breakdown voltage $V_c$ must therefore be selected less than the lowered maximum voltage $V_{max}$ that the lamp can withstand, but it should be higher than $V_s$ so that the lamp can be restarted without having to first cool down completely. A good nominal value for $V_c$ is around 3,000 volts.

The use of the switching device 60 is not limited to reflector lamps. It can also be applied to high pressure sodium lamps having conventional envelopes but which have a rare gas fill rather than a high vacuum. Such lamps might use the rare gas to limit discharge device material evaporation as discussed above. The problem of internal electrical breakdown through the rare gas could also be solved with the switching device as it is in reflector lamps.

What is claimed is:

1. A high pressure sodium discharge lamp, comprising:

an outer lamp envelope;

a high pressure sodium discharge device within said outer envelope and energizable by an applied voltage for emitting light;

means comprising conductors within said outer envelope connected to said discharge device for defining a conductive path to apply a voltage to said discharge device;

an inert gas within said outer envelope;

means comprising a normally nonconductive spark gap within said outer envelope, isolated from said inert gas atmosphere within said outer envelope, and responsive to the voltage between said conductors and applied to said high pressure sodium discharge device for breaking down when the applied voltage exceed a certain predetermined value to prevent breakdown through the inert gas atmosphere between said conductors.

2. A high pressure sodium discharge lamp according to claim 1, wherein said inert gas is argon.

3. A high pressure sodium discharge lamp, comprising:

an outer lamp envelope;

a high pressure sodium discharge device having a characteristic starting voltage and disposed within said outer envelope, said discharge device energizable to initiate a discharge therein and emit light upon the application of a voltage exceeding said characteristic starting voltage to said discharge device, and said discharge device exhibiting an increased starting voltage after said discharge device attains an elevated operating temperature;

conductors within said outer envelope connected to said discharge device for defining a conductive path to apply a voltage to energize said discharge device;

an inert gas atmosphere within said outer envelope, said inert gas atmosphere exhibiting electrical breakdown between said conductors when the applied voltage exceeds a certain breakdown voltage value, said breakdown voltage increasing after said discharge device attains an elevated operating temperature; and means within said outer envelope connected across said conductors and exhibiting a high impedance below a certain applied voltage and a low impedance above said certain applied voltage.

4. A high pressure sodium discharge lamp according to claim 3, wherein said inert gas is argon.

5. A high pressure sodium discharge lamp according to claim 4, wherein said argon gas has a pressure of the order of 700 torr.

6. A high pressure sodium discharge lamp, comprising:

a blown glass outer lamp envelope;

a high pressure sodium discharge device within said outer envelope and energizable by an applied voltage for emitting light, conductors within said outer envelope connected to said discharge device for defining a conductive path to apply a voltage to energize said discharge device;

an inert gas atmosphere within said outer envelope, said inert gas atmosphere having a fill pressure less than one atmosphere and having a pressure of approximately one atmosphere when heated by said discharge device during normal lamp operation, and said inert gas atmosphere exhibiting electrical breakdown between said conductors when the applied voltage exceeds a certain breakdown voltage value; and means comprised of a self-restoring threshold switch for establishing a low impedance circuit path between said conductors and isolated from said argon atmosphere when the voltage between said conductors exceeds the threshold voltage of said threshold switch, said threshold switch having a threshold voltage which is greater than the starting voltage of said discharge device and less than the breakdown voltage of the argon fill gas between said conductors.

7. A high pressure sodium discharge lamp according to claim 6, wherein said blown glass outer envelope is a reflector lamp envelope;

a reflective material is disposed on a portion of said lamp outer envelope for defining a reflector layer; and said conductors comprise mounting means for mounting said discharge device within said outer envelope relative to said reflector layer such that light emitted from said discharge device is incident on said reflector layer and reflected out of said outer envelope.

8. A high pressure sodium discharge lamp according to claim 7, wherein said discharge device is comprised of an elongate discharge vessel having a pair of opposite ends, and a pair of metallic terminals each at an opposite end of said discharge vessel for receiving an electrical potential to operate said discharge device;

said outer envelope is a body of revolution having a tapered lateral wall converging toward a base end of the lamp and diverging toward a lens end of the lamp, said reflector layer being disposed on a portion of said tapered lateral wall;

said mounting being effective for mounting said discharge device axially symmetrically within said outer envelope a predetermined distance selected to determine the beamwidth of the light reflected through the lens end of said outer envelope.

* * * * *